US005971612A

United States Patent [19]

McAuslan

[11] Patent Number: 5,971,612

[45] Date of Patent: Oct. 26, 1999

[54] COILABLE STORAGE DEVICE

[76] Inventor: David N. McAuslan, 39W439 Woodgate Rd., St. Charles, Ill. 60175

[21] Appl. No.: 09/030,370

[22] Filed: Feb. 25, 1998

[51] Int. Cl.[6] ..... B65D 33/30

[52] U.S. Cl. ..... 383/43; 383/39; 383/88

[58] Field of Search ..... 383/43, 39, 85, 383/88, 89

[56] References Cited

U.S. PATENT DOCUMENTS

| | | | |
|---|---|---|---|
| 1,357,496 | 11/1920 | Grundy | 383/43 X |
| 1,828,401 | 10/1931 | Farrand . | |
| 2,826,523 | 3/1958 | Blaszkowski et al. . | |
| 2,845,976 | 8/1958 | Miller . | |
| 3,121,957 | 2/1964 | Brown . | |
| 3,201,030 | 8/1965 | Pollack . | |
| 4,735,246 | 4/1988 | Niehaus . | |
| 4,997,104 | 3/1991 | Polhl | 383/43 X |
| 5,176,452 | 1/1993 | Stern | 383/43 |
| 5,363,953 | 11/1994 | Carter . | |
| 5,373,942 | 12/1994 | Weder . | |
| 5,535,603 | 7/1996 | Hayakawa . | |
| 5,603,401 | 2/1997 | Brunner . | |
| 5,617,947 | 4/1997 | Momjian et al. . | |

*Primary Examiner*—Jes F. Pascua
*Attorney, Agent, or Firm*—Meroni & Meroni

[57] ABSTRACT

A coilable storage device for retaining an article comprising: a metal spring strip, and a piece of material extending across the metal spring strip, wherein the metal spring strip is a relatively thin, elongated piece of metal material having a first end, a second end, a first side edge, and a second side edge. The metal spring strip has an internal lateral bias for maintaining an opened position wherein the metal spring strip is substantially straight longitudinally from the first end to the second end and has a transverse arch from the first side edge to the second side edge. The metal spring strip further has an internal longitudinal bias for maintaining a closed position wherein the metal spring strip is substantially arcuate longitudinally from the first end to the second end and is substantially straight transversely from the first side edge to the second side edge. The metal spring strip is movable from the opened position to the closed position. The piece of material extends across a bottom portion of the metal spring strip opposite the upper portion and is secured to the upper portion of the metal spring strip along the first side edge, the second side edge, and the second end, thereby defining a pocket at the first end when the metal spring strip is placed in the opened position. The pocket allows a user to store an article, such as jewelry therein and keeps the article securely positioned and stored by placing the metal spring strip into the closed position, thereby compressing the article between the metal spring strip and the material extending across the bottom portion.

20 Claims, 1 Drawing Sheet

COILABLE STORAGE DEVICE

BACKGROUND OF THE INVENTION

1. Field of the Invention

The present invention relates generally to a new and improved storage device for small articles. More specifically the present invention provides a unique storage device for securely storing and transporting articles such as jewelry, including necklaces, earrings, rings, and bracelets. Furthermore, the storage device will keep articles from getting tangled or otherwise damaged.

2. Description of the Prior Art

Various different storage devices for storing articles such as jewelry or fishing gear have been disclosed and used in the marketplace, however, these storage devices can be bulky, unattractive, and can cause stored articles to easily tangle and be damaged. Such storage devices include jewelry boxes, tackle boxes, tubes, and various other types of containers and bags. The transportation and storage of jewelry, such as necklaces, earrings, rings, and bracelets; and fishing gear, such as hooks, and lures, can often lead to tangled and/or damaged articles, thereby making it difficult to keep appropriate articles properly organized and safe from damage. It would therefore be desirable to provide a compact, attractive storage device that can protect and organize articles such as jewelry and fishing gear.

These and other types of jewelry storage devices used in the past do not offer the flexibility and inventive features of my coilable storage device. As will be described in greater detail hereinafter, the coilable storage device of the present invention differs from those previously proposed.

SUMMARY OF THE INVENTION

According to my present invention I have provided a coilable storage device for retaining an article comprising: a metal spring strip, and a piece of material extending across the metal spring strip, wherein the metal spring strip is a relatively thin, elongated piece of metal material having a first end, a second end, a first side edge, and a second side edge. The metal spring strip has an internal lateral bias for maintaining an opened position wherein the metal spring strip is substantially straight longitudinally from the first end to the second end and has a transverse arch from the first side edge to the second side edge. The metal spring strip further has an internal longitudinal bias for maintaining a closed position wherein the metal spring strip is substantially arcuate longitudinally from the first end to the second end and is substantially straight transversely from the first side edge to the second side edge. The metal spring strip is movable from the opened position to the closed position by engaging an upper portion of the metal spring strip located on an outer side of the transverse arch. The metal spring strip is movable from the closed position to the opened position by longitudinally straightening the metal spring strip along an entire length of the metal spring strip. The piece of material extends across a bottom portion of the metal spring strip opposite the upper portion and is secured to the upper portion of the metal spring strip along the first side edge, the second side edge, and the second end, thereby defining an opening at the first end, whereby when the metal spring strip is placed in the opened position, the transverse arch forms a pocket between the material extending across the bottom portion of the metal spring strip and the bottom portion of the metal spring strip. The pocket allows a user to store an article therein and keeps the article securely positioned and stored by placing the metal spring strip into the closed position, thereby compressing the article between the metal spring strip and the material extending across the bottom portion.

I have further provided a coilable storage device as described above further including a hook. The hook is secured at the first end of the metal spring strip near the opening of the pocket and allows articles to be hung therefrom, thereby allowing a user to easily insert and remove articles form the coilable storage device.

Still another feature of my invention concerns the coilable storage device described above, wherein the material extending across the bottom portion of the metal spring is translucent and allowing a user to visually determine the contents held within the coilable storage device.

Still yet another feature of my invention concerns the coilable storage device as described above, wherein the piece of material extending across the bottom portion of the metal spring strip has a plurality of pockets for holding a number of different articles within one coilable storage device.

Yet another feature of my invention concerns the coilable storage device as described above, wherein the material extending across the bottom portion of the metal spring strip can be a spandex, nylon, cotton, or plastic material.

A still further feature of my invention concerns the coilable storage device as described above, wherein the metal spring strip has a thickness between 0.002 inches and 0.125 inches.

An even further feature of my invention concerns the coilable storage device described above, wherein the metal spring strip can be: a hardened, tempered, polished, and blued C1095 steel; a hardened, tempered, polished, and blued C1075 spring steel; a spring-tempered type 301 stainless steel; or a spring-tempered alloy 510 phosphor bronze.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
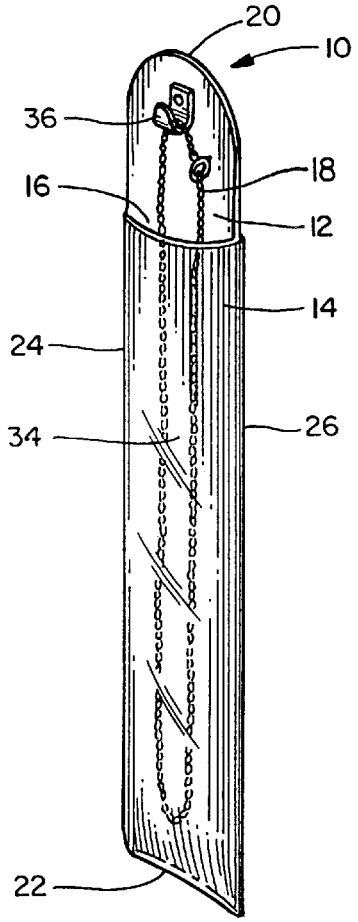
FIG. 1 is a perspective view of my coilable storage device in an opened position illustrating important features of my invention.

Referring now to the drawings, FIG. 1 shows an embodiment of my coilable storage device 10 in an opened position. My coilable storage device comprises a metal spring strip 12 with a piece of material 14 attached thereto forming a pocket 16 for holding articles, such as an item of jewelry 18.

The metal spring strip 12 is a relatively thin, elongated piece of spring metal material having a first end 20, a second end 22, a first side edge 24, and a second side edge 26. The metal spring strip 12 has an internal lateral bias for maintaining an opened position. In the opened position, the metal spring strip is in a substantially straight position longitudinally from the first end 20 to the second end 22 and has a transverse arch from the first side edge 24 to the second side edge 26.

Figure 4:
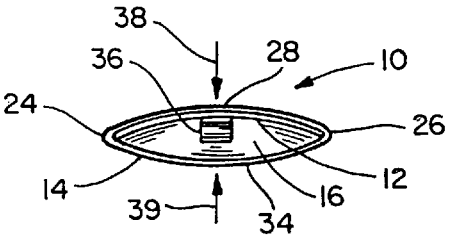
FIG. 4 is a top view of my coilable storage device in an opened position illustrating the pocket formed therein.
Figure 5:
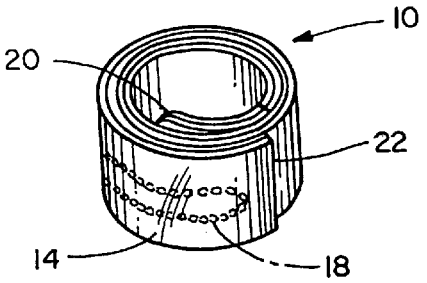
FIG. 5 is a perspective view of my coilable storage device in a closed position illustrating further important features of my invention.
Figure 6:
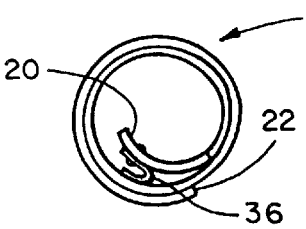
FIG. 6 is a side view of my coilable storage device in a closed position.

The metal spring strip 12 further has an internal longitudinal bias for maintaining a closed position (FIGS. 5 and 6). In the closed position, the metal spring strip is circular or substantially arcuate longitudinally from the first end 20 to the second end 22 with one end overlapping the other end and is substantially straight transversely from the first side edge to the second side edge and having no transverse arch. The metal spring strip 12 is capable of snapping between an opened position having a straight configuration (FIG. 1) to a closed position having a circular configuration (FIG. 5). The metal spring strip 12 is movable from the opened position to the closed position by engaging an upper portion 28 (FIGS. 3 and 4) of the metal spring strip located on an outer side of the transverse arch. The metal spring strip is movable from the closed position back to the opened position by longitudinally straightening the metal spring strip along an entire length of the metal spring strip. Therefore, the metal spring strip 12 is capable of maintaining itself in two positions. The first position, a straight or opened position (FIG. 1). The second position, a circular or closed position (FIG. 5).

The metal spring strip 12 in the straight position has an arch from a first side 24 to a second side 26 (FIG. 1). It should be appreciated that the metal spring strip, once placed in the straight position, remains in the straight position until an external force is applied to it. In other words, the metal spring strip has an internal bias which holds the spring strip in the straight, arched position.

When the metal spring strip is closed, its internal bias is translated from a lateral bias, which arched the spring strip transversely, to a longitudinal bias, which wraps the metal spring strip longitudinally (FIG. 5). The closed metal spring strip is formed in a circle with the second end 22 overlapping the first end 20. As was the case with the straight configuration, the internal bias of the spring strip maintains the spring strip in the closed position until an external force is applied to it.

Figure 3:
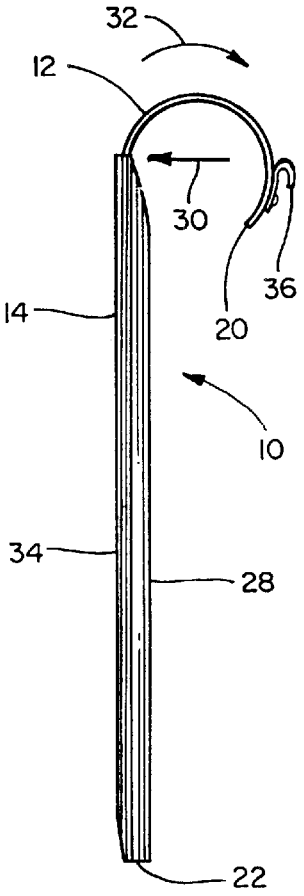
FIG. 3 is a side view of my coilable storage device illustrating the way in which my coilable storage device can be coiled to a closed position.

The snapping movement of the spring strip from the straight position to the closed position is illustrated in FIG. 3. When an external force is applied to flatten a portion of the arch or upper portion 28 of the metal spring strip 12, as indicated by the direction of the arrow 30, the internal bias of the metal spring strip suddenly converts the metal spring strip from the straight configuration to the closed position. Movement of the spring strip partially into the closed position is indicated by direction arrow 32. Although FIG. 3 illustrates the application of an external force to a particular point on the metal spring strip 12, the metal spring strip generally responds to a force applied anywhere along its length.

The metal spring strip 12 is comprised of a spring metal having strength and flexibility consistent with this invention. Excellent results can be obtained using a hardened, tempered, polished, and blued C1095 spring steel with a standard Rockwell hardness of C48 to 51, having a thickness of 0.004 inches, a 1 inch width, and a 9 inch length. One can purchase this type of spring steel from McMaster-Carr Supply Company, P.O. Box 4355, Chicago, Ill. 60680 under catalog number 9036K11. Other types of spring steel can also be used as long as they provide adequate qualities of coiling and straightening in the manners described earlier. Other adequate materials include: hardened, tempered, polished, and blued C1075 spring steel; spring-tempered type 301 stainless steel; and spring-tempered alloy 510 phosphor bronze. These metal spring strips can have a thickness ranging between 0.002 inches and 0.125 inches.

A piece of material 14 extends across a bottom portion 34 of the metal spring strip 12 opposite the upper portion 28. The piece of material 14 is secured to the upper portion 28 of the metal spring strip along the first side edge 24, the second side edge 26, and the second end 22 defining a pocket or an opening 16 at the first end 20 when the metal spring strip 12 is placed in the opened position. The transverse arch forms a pocket between the material extending across the bottom portion of the metal spring strip and the bottom portion of the metal spring strip. The pocket 16 allows a user to store an article 18 within the pocket and keeping the article securely positioned and stored within the pocket by placing the metal spring strip into the closed position. By placing the metal spring strip 12 into a closed position, the article 18 located in the pocket 16 is gently compressed, as indicated by arrows 38, 39 in FIG. 4, between the metal spring strip 12 and the material 14 extending across the bottom portion 34. Furthermore, the tight coiling action of the metal spring strip 12 also acts to securely hold articles stored within the coilable storage device 10. Various different articles could be stored and secured within the pocket, including: necklaces, earrings, rings, bracelets, and fishing gear.

The material 14 is preferably an attractive fabric and can be attached to the metal spring strip 12 in various ways, including adhesively securing the material to the upper portion 28 of the metal spring strip. Additionally, the metal spring strip 12 can be covered or coated by a material that is soft and/or scratch resistant to properly protect any articles that are stored therein.

The coilable storage device can also include a hook 36 secured at the first end 20 of the metal spring strip 12 near the opening of the pocket 16. The hook 3 allows an article 18, such as a necklace, to be hung therefrom. This allows a user to easily insert and remove articles form the coilable storage device by locating appropriate articles onto the hook.

The material 14 that extends across the bottom portion 34 of the metal spring strip 12 can be composed of various different materials including spandex, nylon, cotton, rubber, synthetic rubber, and plastic. Excellent results can be obtained when the material is stretchable. The material can also be a translucent material 14 that allows a user to quickly and easily identify the contents of the coilable storage device 10.

Figure 2:
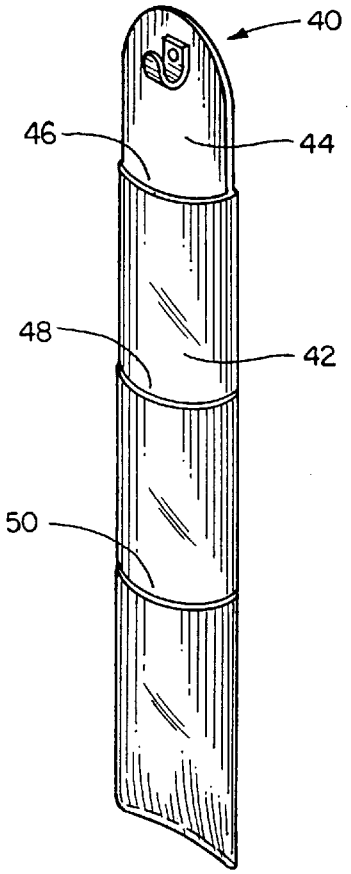
FIG. 2 is a perspective view of another version of my coilable storage device in an opened position illustrating a plurality of pockets.

FIG. 2 illustrates another embodiment of my coilable storage device 40, wherein a piece of material 42 extending across the bottom portion of the metal spring strip 44 defines a plurality of pockets 46, 48, 50 extending across a length of the metal spring strip. The multiple pockets allow a user to store a number of different articles such as earrings, rings, or fishing hooks.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A coilable storage device for retaining an article comprising:

a metal spring strip, said metal spring strip being a relatively thin, elongated piece of metal material having a first end, a second end, a first side edge, and a second side edge, said metal spring strip having an internal lateral bias for maintaining an opened position wherein said metal spring strip is substantially straight longitudinally from the first end to the second end and has a transverse arch from the first side edge to the second side edge, said metal spring strip further having an internal longitudinal bias for maintaining a closed position wherein said metal spring strip is substantially arcuate longitudinally from the first end to the second end and is substantially straight transversely from the first side edge to the second side edge, said metal spring strip being movable from the opened position to the closed position by engaging an upper portion of the metal spring strip located on an outer side of the transverse arch, said metal spring strip being movable from the closed position to the opened position by longitudinally straightening the metal spring strip along an entire length of the metal spring strip; and a piece of material extending across a bottom portion of the metal spring strip opposite the upper portion, said piece of material being secured to the upper portion of the metal spring strip along the first side edge, the second side edge, and the second end defining an opening at the first end, whereby when the metal spring strip is placed in the opened position, the transverse arch forms a pocket between the material extending across the bottom portion of the metal spring strip and the bottom portion of the metal spring strip, said pocket allowing a user to store an article within the pocket and keeping the article securely positioned and stored within the pocket by placing the metal spring strip into the closed position, thereby compressing the article between the metal spring strip and the material extending across the bottom portion.

2. The coilable storage device of claim 1, further including a hook, said hook being secured at the first end of the metal spring strip near the opening of the pocket, said hook allowing articles to be hung therefrom, thereby allowing a user to easily insert and remove articles form the coilable storage device.

3. The coilable storage device of claim 1, wherein said material extending across the bottom portion of the metal spring is translucent.

4. The coilable storage device of claim 1, wherein said piece of material extending across the bottom portion of the metal spring strip defines a plurality of pockets extending across a length of the metal spring strip.

5. The coilable storage device of claim 1, wherein said material extending across the bottom portion of the metal spring strip is a material selected from the group consisting of: spandex, nylon, cotton, rubber, synthetic rubber, and plastic.

6. The coilable storage device of claim 1, wherein said metal spring strip has a thickness between 0.002 inches and 0.125 inches.

7. The coilable storage device of claim 1, wherein said metal spring strip is a material selected from a group consisting of: hardened, tempered, polished, and blued C1095 steel; hardened, tempered, polished, and blued C1075 spring steel; spring-tempered type 301 stainless steel; and spring-tempered alloy 510 phosphor bronze.

8. A coilable jewelry storage device for retaining jewelry comprising:

a metal spring strip, said metal spring strip being a relatively thin, elongated piece of metal material having a first end, a second end, a first side edge, and a second side edge, said metal spring strip having an internal lateral bias for maintaining an opened position wherein said metal spring strip is substantially straight longitudinally from the first end to the second end and has a transverse arch from the first side edge to the second side edge, said metal spring strip further having an internal longitudinal bias for maintaining a closed position wherein said metal spring strip is substantially arcuate longitudinally from the first end to the second end and is substantially straight transversely from the first side edge to the second side edge, said metal spring strip being movable from the opened position to the closed position by engaging an upper portion of the metal spring strip located on an outer side of the transverse arch, said metal spring strip being movable from the closed position to the opened position by longitudinally straightening the metal spring strip along an entire length of the metal spring strip; and a piece of material extending across a bottom portion of the metal spring strip opposite the upper portion, said piece of material being secured to the upper portion of the metal spring strip along the first side edge, the second side edge, and the second end defining an opening at the first end, whereby when the metal spring strip is placed in the opened position, the transverse arch forms a pocket between the material extending across the bottom portion of the metal spring strip and the bottom portion of the metal spring strip, said pocket allowing a user to store jewelry within the pocket and keeping the jewelry securely positioned and stored within the pocket by placing the metal spring strip into the closed position, thereby compressing the jewelry between the metal spring strip and the material extending across the bottom portion.

9. The coilable jewelry storage device of claim 8, further including a hook, said hook being secured at the first end of the metal spring strip near the opening of the pocket, said hook allowing the jewelry to be hung therefrom, thereby allowing a user to easily insert and remove jewelry form the coilable jewelry storage device.

10. The coilable jewelry storage device of claim 9, wherein said material extending across the bottom portion of the metal spring is translucent.

11. The coilable jewelry storage device of claim 8, wherein said piece of material extending across the bottom portion of the metal spring strip defines a plurality of pockets extending across a length of the metal spring strip.

12. The coilable jewelry storage device of claim 8, wherein said material extending across the bottom portion of the metal spring strip is a material selected from the group consisting of: spandex, nylon, cotton, rubber, synthetic rubber, and plastic.

13. The coilable jewelry storage device of claim 12, wherein said metal spring strip has a thickness between 0.002 inches and 0.125 inches.

14. The coilable jewelry storage device of claim 13, wherein said metal spring strip is a material selected from a group consisting of: hardened, tempered, polished, and blued C1095 steel; hardened, tempered, polished, and blued C1075 spring steel; spring-tempered type 301 stainless steel; and spring-tempered alloy 510 phosphor bronze.

15. A coilable storage device for retaining at least one article comprising:

a metal spring strip, said metal spring strip being a relatively thin, elongated piece of metal material having a first end, a second end, a first side edge, and a second side edge, said metal spring strip having an internal lateral bias for maintaining an opened position wherein said metal spring strip is substantially straight longitudinally from the first end to the second end and has a transverse arch from the first side edge to the second side edge, said metal spring strip further having an internal longitudinal bias for maintaining a closed position wherein said metal spring strip is substantially arcuate longitudinally from the first end to the second end and is substantially straight transversely from the first side edge to the second side edge, said metal spring strip being movable from the opened position to the closed position by engaging an upper portion of the metal spring strip located on an outer side of the transverse arch, said metal spring strip being movable from the closed position to the opened position by longitudinally straightening the metal spring strip along an entire length of the metal spring strip; and a piece of material extending across a bottom portion of the metal spring strip opposite the upper portion, said piece of material being secured to the upper portion of the metal spring strip along the first side edge, the second side edge, and the second end defining an opening at the first end, whereby when the metal spring strip is placed in the opened position, the transverse arch forms a pocket between the material extending across the bottom portion of the metal spring strip and the bottom portion of the metal spring strip, said pocket allowing a user to store an article within the pocket and keeping the article securely positioned and stored within the pocket by placing the metal spring strip into the closed position.

16. The coilable storage device of claim 15, further including a hook, said hook being secured at the first end of the metal spring strip near the opening of the pocket, said hook allowing articles to be hung therefrom, thereby allowing a user to easily insert and remove articles form the coilable storage device.

17. The coilable storage device of claim 15, wherein said material extending across the bottom portion of the metal spring is translucent.

18. The coilable storage device of claim 15, wherein said piece of material extending across the bottom portion of the metal spring strip defines a plurality of pockets extending across a length of the metal spring strip.

19. The coilable storage device of claim 15, wherein said material extending across the bottom portion of the metal spring strip is a material selected from the group consisting of: spandex, nylon, cotton, rubber, synthetic rubber, and plastic.

20. The coilable storage device of claim 15, wherein said metal spring strip has a thickness between 0.002 inches and 0.125 inches.

* * * * *